US008981634B2

(12) United States Patent
Henke

(10) Patent No.: US 8,981,634 B2
(45) Date of Patent: Mar. 17, 2015

(54) SPARK PLUG WITH INCREASED MECHANICAL STRENGTH

(71) Applicant: Federal-Mogul Holding Deutschland GmbH, Wiesbaden (DE)

(72) Inventor: Stefan Henke, Köln (DE)

(73) Assignee: Federal-Mogul Ignition GmbH, Neuhaus (DE)

( * ) Notice: Subject to any disclaimer, the term of this patent is extended or adjusted under 35 U.S.C. 154(b) by 0 days.

(21) Appl. No.: 13/890,661

(22) Filed: May 9, 2013

(65) Prior Publication Data

US 2013/0307403 A1 Nov. 21, 2013

Related U.S. Application Data

(60) Provisional application No. 61/645,020, filed on May 9, 2012.

(51) Int. Cl.
*H01T 13/36* (2006.01)

(52) U.S. Cl.
CPC ..... *H01T 13/36* (2013.01)
USPC ..... 313/144; 313/141; 313/143

(58) Field of Classification Search
USPC ..... 313/141, 144
See application file for complete search history.

(56) References Cited

U.S. PATENT DOCUMENTS

| | | | | |
|---|---|---|---|---|
| 1,514,209 | A | 11/1924 | Hansen | |
| 2,250,355 | A * | 7/1941 | Bruck | 313/144 |
| 3,705,951 | A * | 12/1972 | Rausch | 174/152 S |
| 4,871,339 | A * | 10/1989 | Sadegh | 445/7 |
| 7,215,069 | B2 * | 5/2007 | Suzuki | 313/143 |
| 8,143,773 | B2 | 3/2012 | Suzuki et al. | |
| 8,643,263 | B2 * | 2/2014 | Burrows | 313/143 |
| 2010/0141110 | A1 | 6/2010 | Nakamura et al. | |
| 2010/0259154 | A1 | 10/2010 | Nakamura et al. | |
| 2011/0018422 | A1 | 1/2011 | Suzuki et al. | |

FOREIGN PATENT DOCUMENTS

| | | | |
|---|---|---|---|
| DE | 879037 | C | 6/1953 |
| EP | 1931002 | A1 | 6/2008 |
| EP | 2 216 863 | A2 | 11/2010 |
| EP | 2330702 | A1 | 6/2011 |
| FR | 921793 | A | 5/1947 |
| JP | 61-39880 | | 3/1986 |
| WO | WO 2010/035717 | A1 | 1/2010 |

OTHER PUBLICATIONS

Search Report and Written Opinion, PCT/IB2013/8001367, Sep. 10, 2013, 9 pages.

* cited by examiner

*Primary Examiner* — Sikha Roy
(74) *Attorney, Agent, or Firm* — Reising Ethington P.C.

(57) ABSTRACT

A spark plug with a particular configuration, particularly in the area of a gasket that seals between a shell and insulator, increases the mechanical strength of the spark plug and helps prevent breaking, cracking and/or other failures in the insulator. The spark plug is designed such that the shell, insulator and gasket, which may be in the form of a sleeve-like cylindrical gasket or a ring-like annular gasket, work together to provide better support for the insulator against axial and/or radial stresses. This improved support can offset certain stresses, such as radial stress RS that can be exerted against the insulator core nose when the engine experiences knocking or misfiring.

15 Claims, 5 Drawing Sheets

SPARK PLUG WITH INCREASED MECHANICAL STRENGTH

REFERENCE TO RELATED APPLICATIONS

This application claims the benefit of U.S. Provisional Ser. No. 61/645,020 filed on May 9, 2012, the entire contents of which are incorporated herein.

TECHNICAL FIELD

This invention generally relates to spark plugs and other ignition devices for internal combustion engines and, more particularly, to spark plugs with increased mechanical strength to withstand various axial and/or radial stresses

BACKGROUND

Spark plugs for vehicle engines are designed to seal the combustion chamber so that exhaust gases cannot vent directly into the atmosphere, but instead must pass through an appropriate vehicle exhaust system.

With reference to FIGS. 1-1B, there is shown a cross-sectional view of a spark plug 10 having a conventional arrangement that includes a shell 12, insulator 14, center electrode assembly 16, and ground electrode 18. An external seal is established between shell 12 and the cylinder head (not shown) when the spark plug is installed and screwed into the cylinder head so that a conical shell seat or a separate external gasket 20 is compressed against a seat portion in the cylinder head. An internal seal, on the other hand, is established between insulator 14 and shell 12 and is typically achieved with a separate internal gasket or gasket ring 22, which is located between a seat portion 30 of the shell and a shoulder portion 32 of the insulator. According to this design, internal gasket 22 is a tapered ring that contacts seat and shoulder portions 30, 32 with side surfaces 40, 42 of the gasket, respectively, as opposed to contacting such portions with end surfaces 44, 46 of the gasket. In order to ensure that the internal seal sufficiently seals or blocks off exhaust gases that are under pressure in the combustion chamber, the insulator, gasket ring and shell are usually pre-loaded or compressed in the axial direction so that a good seal is formed. Axially or compressively pre-loading these components, however, can introduce an axial stress AS into insulator 14.

One area of insulator 14 that tends to be vulnerable to stress and breaking is the area of the insulator between positions B and C in FIGS. 1-1B. This is particularly true if the axial stress AS from the pre-loading is coupled with a radial or bending stress RS that is exerted against the insulator core nose 36 in an area between positions A and B. A potential source of the radial stress RS is a pressure wave resulting from engine knock or other misfiring events. If the overall or combined stress (e.g., stresses AS+RS) exceeds the internal strength of insulator 14, which is usually made from a somewhat brittle ceramic material, then the insulator can crack, break or otherwise fail.

SUMMARY

According to one aspect, there is provided a spark plug, comprising: a metallic shell having an internal surface with a seat portion; an insulator having an external surface with a shoulder portion and being at least partially located within the metallic shell; a gasket having upper and lower axial ends and being at least partially located between the metallic shell and the insulator; a center electrode being at least partially located within the insulator; and a ground electrode being attached to the metallic shell. The gasket upper axial end has a mating surface that contacts the insulator shoulder portion and the gasket lower axial end has a mating surface that contacts the shell seat portion so that the insulator and metallic shell are sealed together.

According to another aspect, there is provided a spark plug, comprising: a metallic shell having an internal surface with a seat portion; an insulator having an external surface with a shoulder portion and being at least partially located within the metallic shell; an annular cavity being formed between the metallic shell internal surface and the insulator external surface and being substantially enclosed; a gasket having upper and lower axial ends and being located within the substantially enclosed annular cavity; a center electrode being at least partially located within the insulator; and a ground electrode being attached to the metallic shell. The gasket is compressed in the axial direction between the insulator shoulder portion and the shell seat portion so that the gasket expands in the radial direction and presses against the insulator external surface and the shell internal surface.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 2A:
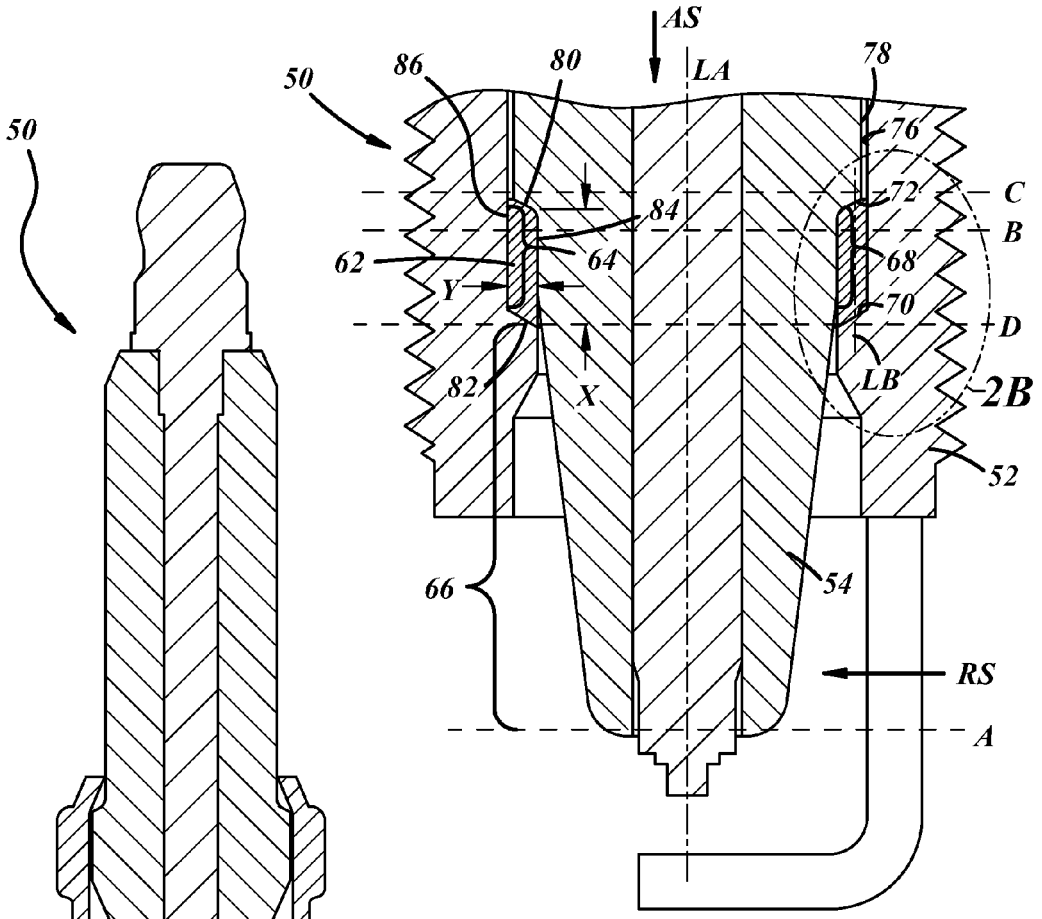
FIGS. 2A-2B are enlarged insets of FIG. 2.
Figure 2:
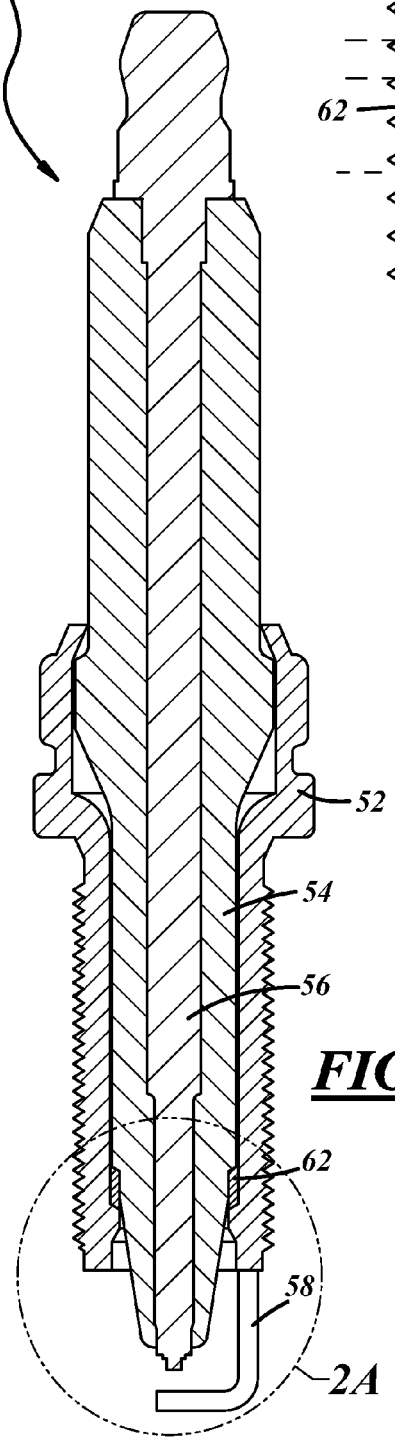
FIG. 2 is a cross-sectional view of a spark plug with an exemplary insulator, shell and gasket arrangement that uses a generally cylindrical shaped gasket to improve the mechanical strength of the plug.
Figure 3:
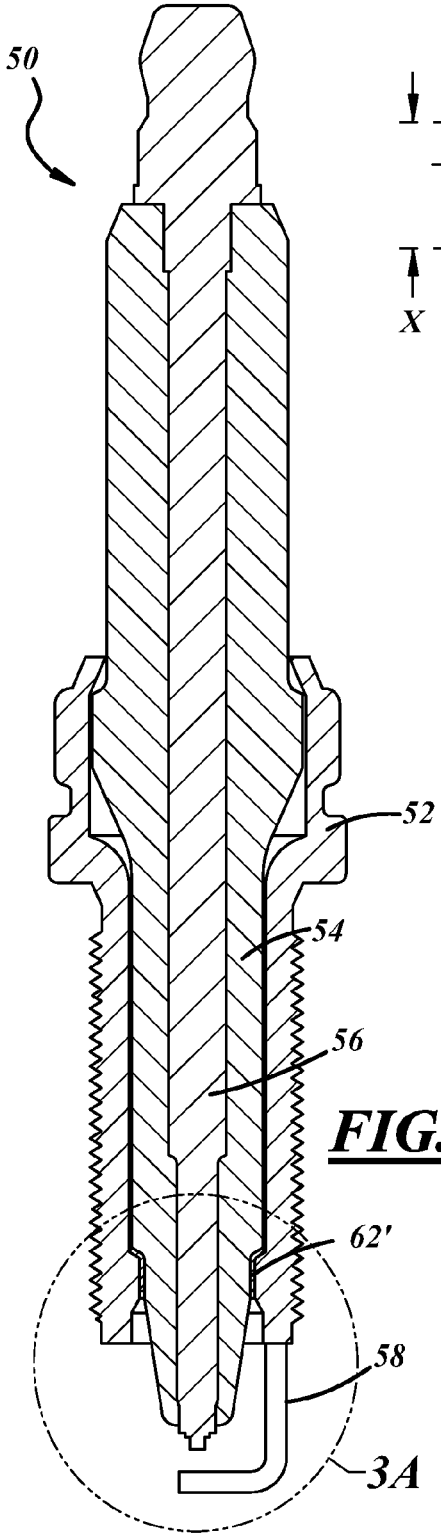
FIG. 3 is a cross-sectional view of a spark plug with another exemplary insulator, shell and gasket arrangement that uses a gasket with cylindrical and flange portions to improve the mechanical strength of the plug.
Figure 3A:
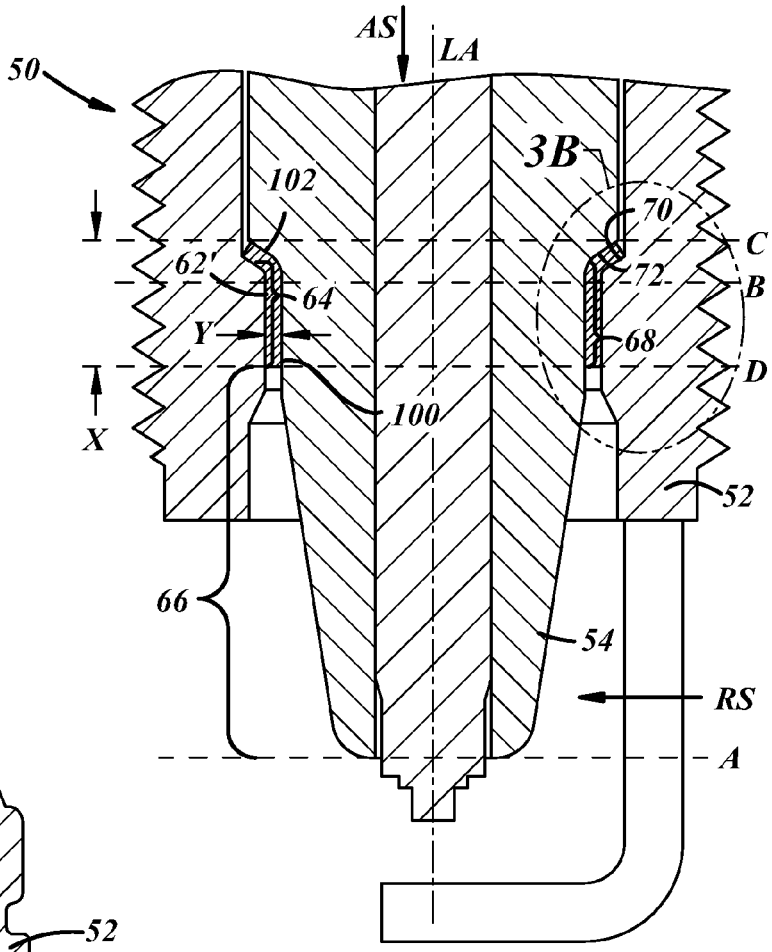
FIGS. 3A-3B are enlarged insets of FIG. 3.
Figure 4:
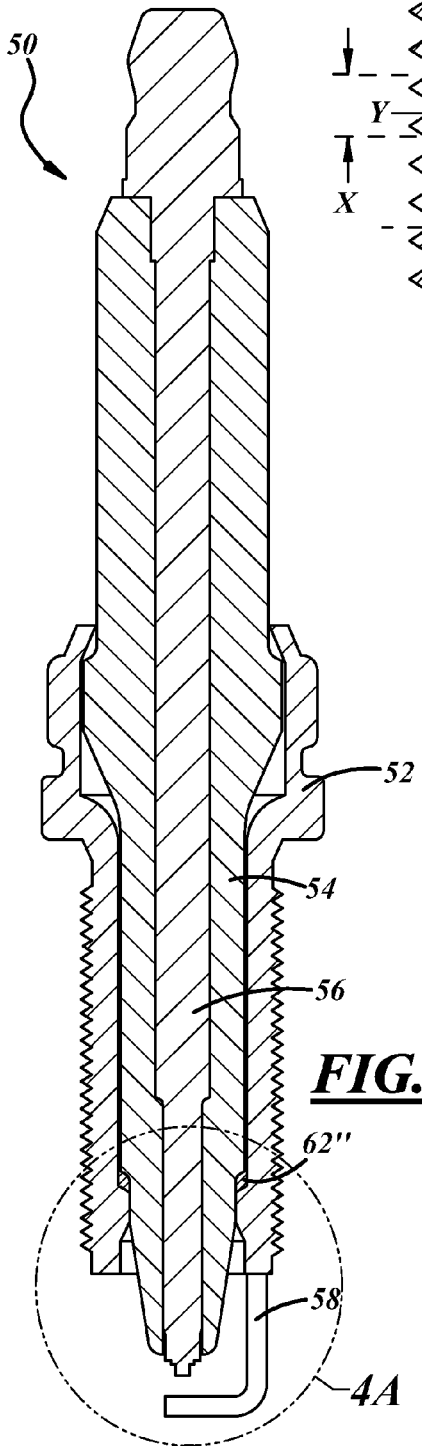
FIG. 4 is a cross-sectional view of a spark plug with an exemplary insulator, shell and gasket arrangement that uses a generally annular shaped gasket to improve the mechanical strength of the plug.

The spark plug embodiments described below have particular configurations that increase the mechanical strength of the spark plug and help prevent breaking, cracking and/or other failures in the insulator. According to the exemplary arrangements shown in FIGS. 2-4, spark plug 50 includes a metallic shell 52, insulator 54, center electrode 56, and ground electrode 58 and is designed such that the shell, the insulator and a gasket 62, 62', 62" work together to provide better support for the insulator against axial and/or radial stresses. This improved support offsets certain stresses, such as radial stress RS that can be exerted against the insulator core nose 66 when the engine experiences knocking or misfiring and can lead to cracking, breaking or other failures of the insulator. If insulator 54 is damaged, high-voltage electrical current may flow directly from center electrode assembly 56 to shell 52 during operation such that it bypasses the intended spark gap; this, in turn, can result in improper combustion and engine operation. FIGS. 2-4 show three different potential embodiments, although others are certainly possible, and will be described in the following paragraphs.

Figure 2B:
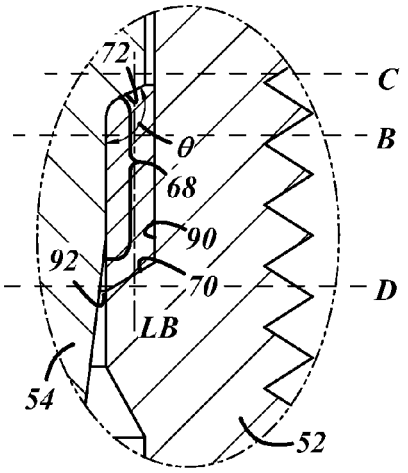

Turning now to FIGS. 2-2B, there is shown a spark plug 50 that has an insulator 54 with increased or improved radial support in between positions B and D, which corresponds to an area between seat portion 70 of the shell and shoulder portion 72 of the insulator where the insulator is sometimes prone to weakness. In this particular embodiment, gasket 62 is a sleeve-like cylindrical gasket that has upper and lower axial ends 80, 82 separated by an axial length X and inner and outer radial sides 84, 86 separated by a radial width Y. The sleeve-like design allows cylindrical gasket 62 to brace supported portion 68 across an axial length so that the insulator is supported at a location below shoulder portion 72. The cylindrical gasket 62 may be aligned upright so that a cross-section of the cylindrical gasket has a longitudinal axis LB that is generally parallel to a longitudinal axis LA of the spark plug.

Upper and lower axial ends 80 and 82 may be angled or tapered and include mating surfaces so that they can tightly mate with corresponding angled surfaces of shoulder portion 72 and seat portion 70, respectively. This arrangement—where gasket 62 is located within an annular cavity 90 formed between an internal surface 76 of the metallic shell and an external surface 78 of the insulator—can seal the insulator and the shell together and can also provide better support for the insulator for improved mechanical strength. As best illustrated in FIG. 2B, the walls of the annular cavity 90 surround the entire gasket 62 so that the cavity is substantially enclosed; if the walls of the cavity contact all of the sides of the gasket, yet allow for a small opening, like opening 92, this is deemed to be "substantially enclosed." In this particular embodiment, upper and lower axial ends 80, 82 are angled in a generally parallel manner to one another and inner and outer radial sides 84, 86 are straight in a generally parallel manner to one another. This results in a cross-sectional shape of the gasket that is a parallelogram, however, other configurations are possible so long as an adequate seal is formed. As shown in FIG. 2B, the mating surface of the upper axial end 80 can be angled and form an obtuse angle θ with inner radial side 84, however, this is optional.

Inner and outer radial sides 84 and 86 of the gasket are designed to flushly contact and seal up against a supported portion 68 of the insulator and a supportive portion 64 of the shell, respectively. In the embodiment of FIGS. 2-2B, both the supported and supportive portions 68, 64 are generally straight and parallel to one another, which results in the inner and outer radial sides 84, 86 of the gasket also being straight and parallel to one another, as well as being parallel to a longitudinal axis LA of the spark plug. The axial length X of gasket 62 is equal to or greater than its radial width Y so that it can act as an elongated supportive sleeve to brace insulator portion 68 in the radial direction; the insulator is sometimes most vulnerable or susceptible to radial bending and breaking in the area of supported portion 68, which in this case is just above shell seat portion 70. Gasket 62 may be comprised of any suitable spark plug seal or gasket material, including compressed glass/metal powder.

To achieve a strong radial support of the insulator in the area of supported portion 68, the cylindrical gasket 62 may be radially press-fit between the insulator and shell at portions 64 and 68. However, during engine operation the temperatures of the individual components of the spark plug increase differently and expand and contract at different rates, which can lead to a relaxation of the radial press-fit of gasket 62. To counteract this phenomenon, it may be helpful to press-fit or otherwise assembly gasket 62 in a heated condition onto a cool insulator 54. If gasket 62 is compressed in the axial direction between shoulder portion 72 and seat portion 70, the inner and outer radial sides 84 and 86 can expand away from one another and press against supported portion 68 and supportive portion 64, respectively. Other techniques may be employed as well.

Figure 1:
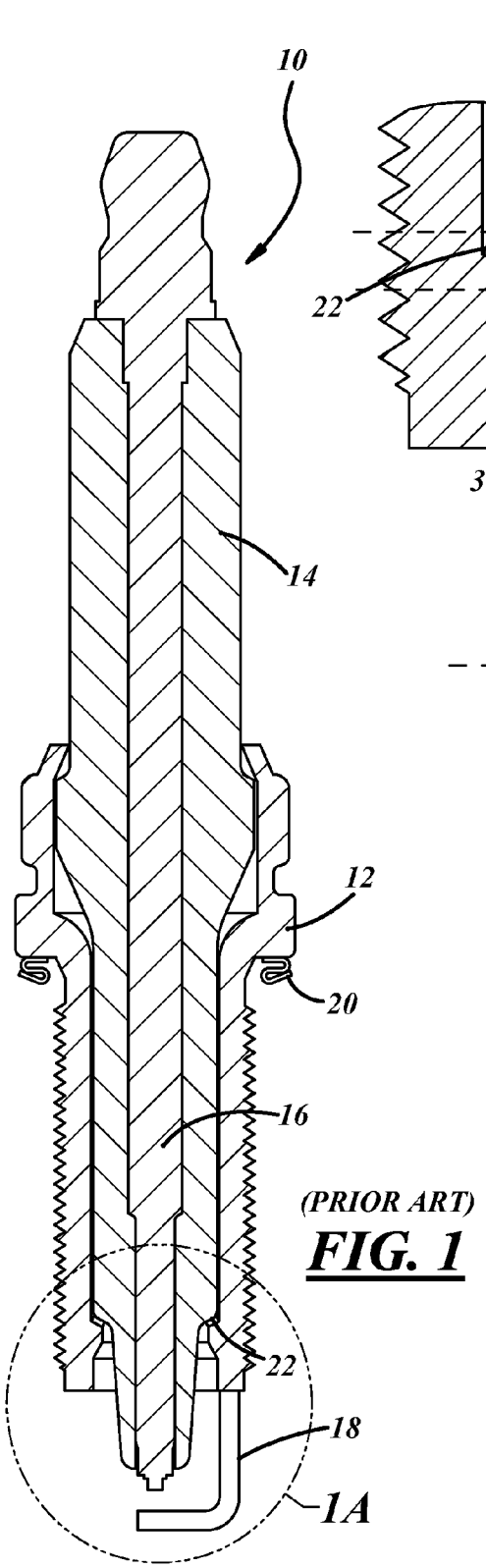
(PRIOR ART) FIG. 1
FIG. 1 is a cross-sectional view of a spark plug with a conventional insulator and internal gasket arrangement.
Figure 1A:
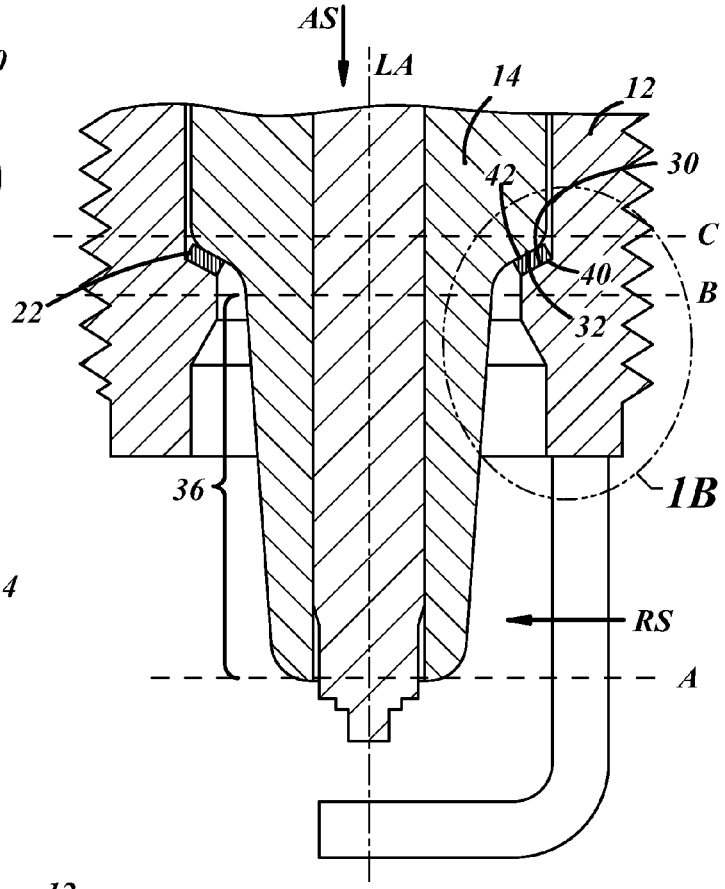
FIGS. 1A-1B are enlarged insets of FIG. 1.
Figure 1B:
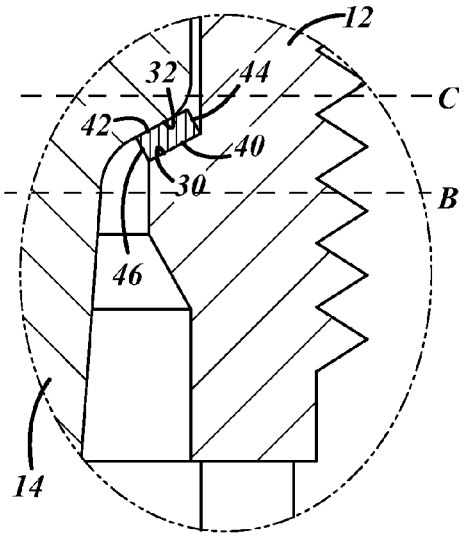
Figure 5:
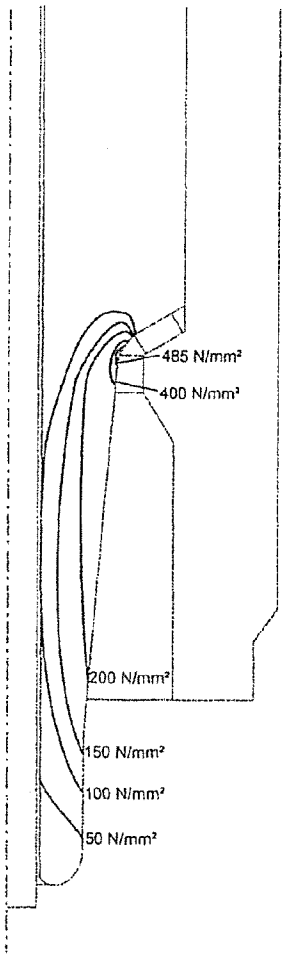
FIGS. 5 and 6 are graphs showing the results of stress reduction using finite element analysis (FEA), where the FIG. 5 graph is for a conventional spark plug and the FIG. 6 graph is for one of the exemplary spark plugs of the present application.
Figure 6:
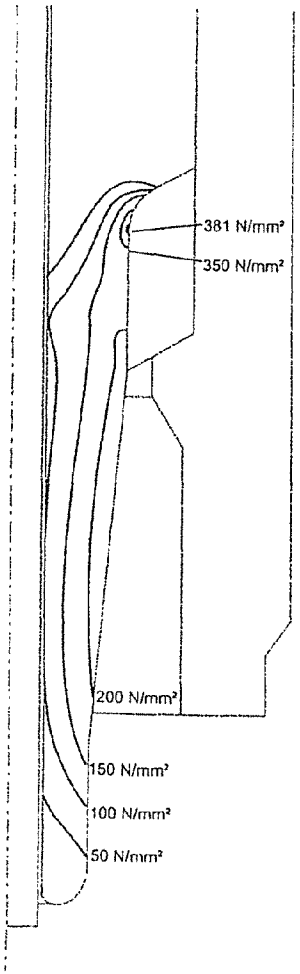

The stress reduction effect of the exemplary spark plug design was modeled in a finite element analysis (FEA) and the comparison to a conventional spark plug is shown in FIGS. 5 and 6. Both calculations consider the same assembly loads and the same external bending force. While the conventional spark plug shows a maximum principal stress of approximately 485N/mm$^2$ due to the super-position of pre-loaded axial stress and a radial bending stress in the same area (shown in FIG. 5), the stress shown is reduced to about 381N/mm$^2$ when spark plug 50 is subject to the same forces. The stress can be further reduced by shortening the bending arm of the insulator, as described next. The pre-loaded axial stress mentioned above leads to a pre-stressing of the insulator just below insulator shoulder portion 72, between positions B and C. The cylindrical and sleeve-like gasket 62 can act as a radial support for the insulator between positions B and D. Put differently, the configuration of the insulator, gasket and shell may result in a partitioning of the axial and radial stresses (AS, RS) so that they are not superimposed or focused in the same area between positions C and B, as was the case with spark plug 10 in FIG. 1. By partitioning these stresses, as opposed to allowing them to concentrate in a small, unsupported area, spark plug 50 is able to reduce the risk of the insulator cracking, breaking or otherwise failing.

Figure 3B:
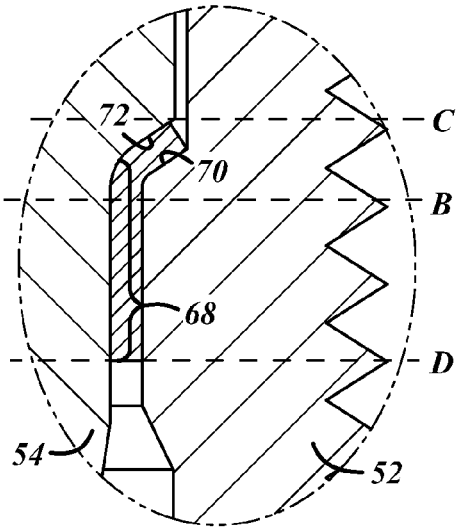

With reference to FIGS. 3-3B, there is shown another example of a spark plug 50 that provides increased radial support of an insulator 54 in an area that can be susceptible to multiple stresses. In this embodiment, where like reference numerals refer to the same components as the previous embodiment, gasket 62' has a somewhat different configuration than that of the last embodiment and is largely located below seat portion 70 of the shell, as opposed to above it. Here, gasket 62' has a cylindrical portion 100 that is integrally formed with a flange or collar portion 102 at its upper end. Cylindrical portion 100 is somewhat sleeve-like and tightly surrounds and gives radial support to portion 68 of the insulator, where flange portion 102 flares out and extends away from the cylindrical portion so that it receives shoulder portion 72 of the insulator. Flange portion 102 helps maintain gasket 62' in its proper position. By locating gasket 62' mostly below shell seat portion 70, this embodiment is able to reduce the bending arm which results in a further reduction of axial or tensile stress in the area between positions B and C. As with the last embodiment, the axial length X of gasket 62' is preferably greater than or equal to its radial width Y (in the illustrated example of FIG. 3, the radial width Y is quite thin so that axial length X is several times larger than Y, although this is not mandatory).

Figure 4A:
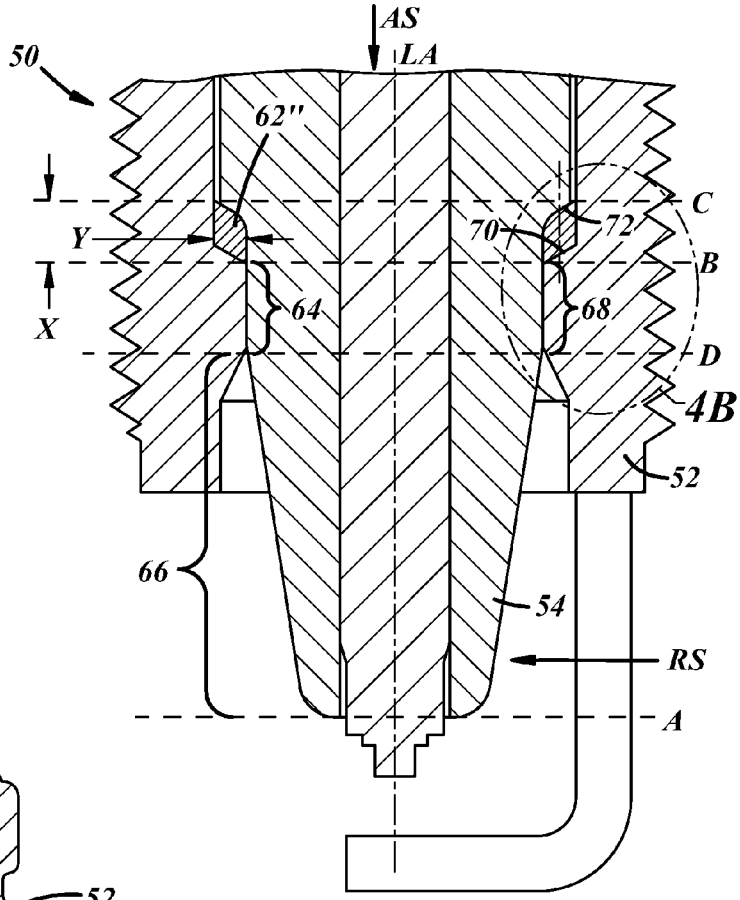
FIGS. 4A-4B are enlarged insets of FIG. 4.
Figure 4B:
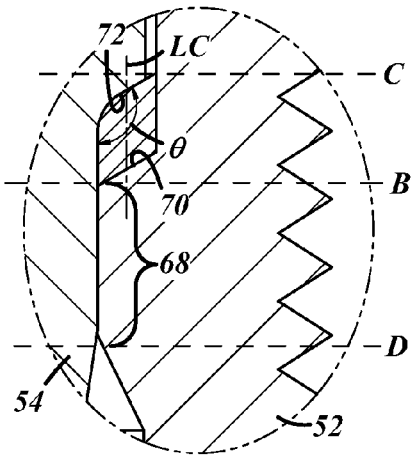

Turning now to FIGS. 4-4B, there is shown yet another example of a spark plug 50 with a particular configuration designed to increase the support for insulator 54 in an area that can be vulnerable to various stresses. According to this exemplary embodiment, where like reference numerals refer to the same components as the previous embodiments, supported portion 68 of the insulator is radially supported or braced not by the gasket alone, as in the past embodiments, but by the inner radial side of the gasket and the supportive portion 64 of the shell which together form a unified supporting surface that supports or braces the insulator. From FIGS. 4A-B, it can be seen that the external surface of the insulator directly contacts or abuts the internal surface of the shell, and does so in a manner so that gives the insulator radial support all along its supported portion 68 between positions B and D. Gasket 62" is much like that of the FIG. 2 embodiment, only it is shorter in the axial direction and is flushly aligned with supportive portion 68 along its inner radial side. In this particular case, the axial length X is approximately equal to the radial thickness Y such that the annular gasket is more ring-like than sleeve-like. Gasket 62" is located between insulator shoulder portion 72 and shell seat portion 70 and seals the combustion chamber at this point. Generally speaking, the gasket 62" addresses or at least mitigates some of the axial stresses AS resulting from pre-loading or compressing the relevant components, and supportive portion 64 of the shell addresses the radial stresses RS by radially supporting the insulator.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an internal surface with a seat portion;

an insulator having an external surface with a shoulder portion, a supported portion, and a tapered core nose and being at least partially located within the metallic shell, the supported portion extends between the shoulder portion and the tapered core nose and is parallel to a longitudinal axis LA of the spark plug;

a gasket having upper and lower axial ends and being at least partially located between the metallic shell and the insulator;

a center electrode being at least partially located within the insulator; and a ground electrode being attached to the metallic shell;

wherein the gasket upper axial end has a mating surface that contacts the insulator shoulder portion and the gasket lower axial end has a mating surface that contacts the shell seat portion, the gasket is compressed in the axial direction between the insulator shoulder portion and the shell seat portion so that the gasket supports the insulator supported portion against radial stress (RS) and the insulator and metallic shell are sealed together.

2. The spark plug of claim 1, wherein the gasket is located within an annular cavity formed between the metallic shell internal surface and the insulator external surface, and the walls of the annular cavity surround the entire gasket so that the annular cavity is substantially enclosed.

3. The spark plug of claim 2, wherein the gasket further includes inner and outer radial sides that extend between the upper and lower axial ends, and the gasket upper axial end and the gasket inner radial side are in contact with the insulator external surface and the gasket lower axial end and the gasket outer radial side are in contact with the shell internal surface.

4. The spark plug of claim 3, wherein the gasket is compressed in the axial direction between the insulator shoulder portion and the shell seat portion so that the inner and outer radial sides expand away from one another and press against a supported portion of the insulator and a supportive portion of the shell, respectively.

5. The spark plug of claim 1, wherein the gasket is a sleeve-like cylindrical gasket and further includes upper and lower axial ends separated by an axial length X and inner and outer radial sides separated by a radial width Y, and the axial length X is greater than the radial width Y.

6. The spark plug of claim 5, wherein a cross-section of the cylindrical gasket is in the shape of a parallelogram with the upper and lower axial ends parallel to one another and the inner and outer radial sides parallel to one another, and the inner and outer radial sides are generally parallel to a longitudinal axis LA of the spark plug.

7. The spark plug of claim 5, wherein the cylindrical gasket is aligned upright so that a cross-section of the cylindrical gasket has a longitudinal axis LB that is generally parallel to a longitudinal axis LA of the spark plug.

8. The spark plug of claim 5, wherein the gasket upper axial end mating surface is angled and mates with an angled insulator shoulder portion, and the gasket upper axial end mating surface forms an obtuse angle θ with the gasket inner radial side.

9. The spark plug of claim 5, wherein the gasket inner radial side extends between the gasket upper and lower axial ends and contacts a supported portion of the insulator across an axial length so that the insulator is supported against radial stress (RS) at a location below the insulator shoulder.

10. The spark plug of claim 1, wherein the gasket is a ring-like annular gasket and further includes inner and outer radial sides that extend between the upper and lower axial ends, and the gasket inner radial side is flushly aligned with a supportive portion of the shell to form a unified supporting surface that supports the insulator at a location below the insulator shoulder.

11. The spark plug of claim 10, wherein a cross-section of the annular gasket is in the shape of a parallelogram with the upper and lower axial ends parallel to one another and the inner and outer radial sides parallel to one another, and the inner and outer radial sides are generally parallel to a longitudinal axis LA of the spark plug.

12. The spark plug of claim 10, wherein the annular gasket is aligned upright so that a cross-section of the annular gasket has a longitudinal axis LC that is generally parallel to a longitudinal axis LA of the spark plug.

13. The spark plug of claim 10, wherein the gasket upper axial end mating surface is angled and mates with an angled insulator shoulder portion, and the gasket upper axial end mating surface forms an obtuse angle θ with the gasket inner radial side.

14. The spark plug of claim 10, wherein the gasket inner radial side extends between the gasket upper and lower axial ends and contacts a supported portion of the insulator across an axial length so that the insulator is supported against radial stress (RS) at a location below the insulator shoulder.

15. A spark plug, comprising:

a metallic shell having an internal surface with a seat portion;

an insulator having an external surface with a shoulder portion, a supported portion, and a tapered core nose and being at least partially located within the metallic shell, the supported portion extends between the shoulder portion and the tapered core nose and is parallel to a longitudinal axis LA of the spark plug;

an annular cavity being formed between the metallic shell internal surface and the insulator external surface and being substantially enclosed;

a gasket having upper and lower axial ends and inner and outer radial sides and being located within the substantially enclosed annular cavity;

a center electrode being at least partially located within the insulator; and a ground electrode being attached to the metallic shell;

wherein the gasket is compressed in the axial direction between the insulator shoulder portion and the shell seat portion so that the gasket inner and outer radial sides expand away from one another and press against the insulator external surface and the shell internal surface, respectively.

* * * * *